US008303739B2

(12) United States Patent
Ishizuka et al.

(10) Patent No.: US 8,303,739 B2
(45) Date of Patent: Nov. 6, 2012

(54) METHOD FOR PRODUCING HIGH-STRENGTH HOT-DIP GALVANNEALED STEEL SHEET

(75) Inventors: Kiyokazu Ishizuka, Himeji (JP); Kazumi Nishimura, Himeji (JP); Ikuo Kikuchi, Himeji (JP); Kaoru Kawasaki, Himeji (JP); Junji Haji, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 1000 days.

(21) Appl. No.: 11/912,037

(22) PCT Filed: Apr. 14, 2006

(86) PCT No.: PCT/JP2006/308376

§ 371 (c)(1), (2), (4) Date: Dec. 10, 2008

(87) PCT Pub. No.: WO2006/112520

PCT Pub. Date: Oct. 26, 2006

(65) Prior Publication Data

US 2009/0211668 A1 Aug. 27, 2009

(30) Foreign Application Priority Data

Apr. 20, 2005 (JP) ..... 2005-121830
May 18, 2005 (JP) ..... 2005-145023

(51) Int. Cl.
*C21D 9/46* (2006.01)
*B05D 3/02* (2006.01)

(52) U.S. Cl. ..... 148/529; 427/321

(58) Field of Classification Search ..... 148/529; 427/321

See application file for complete search history.

(56) References Cited

U.S. PATENT DOCUMENTS

2007/0190353 A1* 8/2007 Taniguchi et al. ..... 428/659

FOREIGN PATENT DOCUMENTS

| | | | |
|---|---|---|---|
| JP | 03-024255 | | 2/1991 |
| JP | 03061352 | A * | 3/1991 |
| JP | 04-333552 | | 11/1992 |
| JP | 04333552 | | 11/1992 |
| JP | 04-346647 | | 12/1992 |
| JP | 04346644 | A * | 12/1992 |
| JP | 04346647 | A * | 12/1992 |
| JP | 06128758 | | 5/1994 |
| JP | 07003417 | | 1/1995 |
| JP | 07009055 | | 2/1995 |
| JP | 07034213 | | 2/1995 |
| KR | 2003-0091942 | | 12/2003 |
| WO | 02/42512 | | 5/2002 |

OTHER PUBLICATIONS

Korean Search Report for associated Korean Patent Application No. 519987013130.

* cited by examiner

*Primary Examiner* — Jessica L Ward
*Assistant Examiner* — Alexander Polyansky
(74) *Attorney, Agent, or Firm* — Dorsey & Whitney LLP

(57) ABSTRACT

Exemplary embodiments of the present invention can provide a method for producing hot dip galvannealed steel sheet which exhibits high strength, high ductility, and a significant degree of alloying. Such exemplary method can be applied to, e.g., a pickled hot rolled steel sheet or an annealed and pickled cold rolled steel sheet containing between about 0.02% and about 0.2% C and between about 0.15% and about 2.5% Mn, and may include one or more procedures for rinsing the sheet, preplating the sheet with Ni, rapidly heating the sheet in a nonoxidizing atmosphere to a sheet temperature of about 430° C. to 500° C., then hot dip plating the sheet in a galvanizing bath containing between about 0.05% and about 0.2% Al, and then immediately heating the sheet rapidly for an alloying treatment. Such exemplary method can provide an improved alloying speed, improved plating appearance and better plating adhesion.

4 Claims, No Drawings

METHOD FOR PRODUCING HIGH-STRENGTH HOT-DIP GALVANNEALED STEEL SHEET

CROSS-REFERENCE TO RELATED APPLICATIONS

This application is a national stage application of PCT Application No. PCT/JP2006/308376 which was filed on Apr. 14, 2006, and published on Oct. 26, 2006 as International Publication No. WO 2006/112520. This application claims priority from the International Application pursuant to 35 U.S.C. §365, and from Japanese Patent Application No. 2005-121830, filed Apr. 20, 2005, and Japanese Patent Application No. 2005-145023, filed May 18, 2005, under 35 U.S.C. §119. The entire disclosures of the above-referenced applications are incorporated herein by reference in their entireties.

FIELD OF THE INVENTION

The present invention relates to a method for producing high-strength hot-dip galvannealed steel sheet, including, e.g., including a utilization of Ni preplating to obtain a good plating performance and to reduce or minimize a deterioration in quality which may arise from a heat treatment during hot-dip galvanization and/or an alloying treatment.

BACKGROUND INFORMATION

High strength, high ductility steel sheets can be used for internal and exterior body panels, chassis parts, etc., for reducing the weight of automobiles. Hot-dip galvannealed steel sheet may be used in such applications to provide good corrosion resistance. However, C and Mn which may be added to steel (e.g., steel sheet) to increase strength can retard alloying during galvanization. Obtaining both strength and a sufficient degree of alloying in such steel sheet can be difficult. For example, a steel sheet containing 0.2% or more Si can exhibit insufficient wettability of the plating, and alloying may also not proceed easily, when applying a conventional Senzimir type hot-dip galvanizing technique to such steel sheet.

A method for producing hot-dip galvannealed steel sheet which utilizes Ni preplating of a base steel sheet containing 0.2% to 0.5% Si, which may help to address these shortcomings, is described, e.g., in Japanese Patent No. 2526320, the entire disclosure of which is incorporated herein by reference.

For example, a presence of P in steel can inhibit and delay an alloying reaction of zinc. An alloying time longer than that used for ordinary steel sheet may be required, which can reduce productivity. Further, when using a single manufacturing line to produce both steel sheet with a fast alloying speed (for example, ultralow carbon steel sheet to which Ti or Nb is added) and steel sheet to which P is added, it may be necessary to optimally manage an Al concentration in the hot-dip galvanizing bath, alloying treatment conditions, etc., and thus processing of such materials may become complicated.

In view of the problems described herein, it may be desirable to improve alloying speed of P-containing steel sheet. For example, a processing technique which includes preplating high tension steel sheet containing P with Ni, heating it under predetermined conditions, hot-dip galvanizing it, then heat alloying it under predetermined conditions is described, e.g., in Japanese Patent No. 2526320, the entire disclosure of which is incorporated herein by reference. However, it may still be difficult to produce high strength, high ductility hot-dip galvannealed steel sheet exhibiting a strength greater than 590 MPa using the technique described in this Japanese patent. A long soaking time may also be preferred to secure a sufficient degree of alloying when using such technique. As a result, both strength and ductility can drop significantly, so application of this technique to automobile internal and exterior body panels, chassis parts, etc. having a complicated shape may be limited. Further, when applying the technique described in this Japanese patent to a base steel sheet containing P, a plating appearance may likely become uneven, which may thus be unsuitable for automobile applications, e.g., for sheet used as exterior panels.

A further processing technique which includes annealing P-containing steel sheet, pickling such steel sheet, cleaning the surface, then galvanizing it, plating it, and heat alloying it is described, e.g., in Japanese Patent Publication (B2) No. 7-9055, the entire disclosure of which is incorporated herein by reference. A heat alloying treatment time used in this technique can be relatively long, and obtaining an appearance of sufficient quality for application to automobiles, in particular for external panels, may be difficult.

SUMMARY OF EXEMPLARY EMBODIMENTS OF THE INVENTION

To address at least some of the problems described herein, exemplary embodiments of the present invention can provide a method for producing hot-dip galvannealed steel sheet which can achieve high strength, high ductility, and a significant degree of alloying. Further, exemplary embodiments of the present invention can provide a method for hot-dip galvannealing P-containing steel sheet which allows both an improvement in alloying speed and improved performance of the galvannealing process, such as a good plating appearance and an improved plating adhesion.

For example, a reduction in the strength and ductility can be reduced or minimized by using alloying heat treatment conditions in a hot-dip galvannealing process which include rapidly heating the steel sheet to a temperature between 470° C. and 550° C. at a heating rate of 30° C./sec or more, holding at the high temperature to soak for less than 10 seconds, and then cooling the sheet. However, such alloying conditions may not achieve a desired degree of alloying. For example, alloying under such conditions may proceed poorly when using a steel sheet containing Si. However, a state of the base sheet used and pretreatment conditions for a Ni preplating may be optimized in accordance with exemplary embodiments of the present invention to achieve high strength, high ductility, and a sufficient degree of alloying.

Thus, exemplary embodiments of the present invention can provide a method which includes, e.g., pickling (i) a pickled hot rolled steel sheet containing between 0.02% and 0.2% C, and between 0.15% and 2.5% Mn as primary components, or (ii) an annealed and pickled cold rolled steel sheet, rinsing the sheet and, without drying the sheet, preplating it with an amount of Ni between 0.2 and 2.0 g/m$^2$. The sheet may be rapidly heated in a nonoxidizing or reducing atmosphere to a sheet temperature of 430° C. to 500° C. at a heating rate of 30° C./sec or more. The sheet may then be hot-dip plated in a galvanizing bath containing between 0.05% and 0.2% Al, wiped, then immediately heated to a temperature of 470° C. to 550° C. at a heating rate of 30° C./sec or more. Further, the sheet can be cooled without taking any soaking time, or holding it to soak for less than 10 seconds and then cooling it. The rinsing water used after the pickling treatment may preferably have a pH of less than 6. In certain exemplary embodiments of the present invention, Ni can be preplated after the pickling treatment without rinsing or drying. The steel sheet used may also contain between 0.2% and 3% Si.

The processing of a high steel sheet containing 0.02% or more of P is described, e.g., in Japanese Patent Publication (B2) No. 7-9055. Exemplary embodiments of the present invention can provide an improved alloying speed and a good plating appearance as compared to the technique described in this Japanese publication, even when an Al concentration in the hot-dip galvanizing bath is high. Pickling P-containing steel sheet after annealing two times can be effective for achieving such results. For example, certain exemplary embodiments of the present invention can provide a method for producing high-strength hot-dip galvannealed steel sheet which includes, e.g. pickling annealed high-strength steel sheet containing 0.02% or more of P, drying the sheet and further pickling it, then preplating the sheet with Ni, heating it in a nonoxidizing atmosphere to a temperature of 430° C. to 500° C., plating the sheet in a hot-dip galvanizing bath containing between 0.05% and 0.2% Al, and then heat alloying the sheet.

Thus, exemplary embodiments of the present invention can provide a method for producing hot-dip galvannealed steel sheet able to achieve both high strength/high ductility and the alloying degree. Further, P-containing steel sheet can be hot-dip galvannealed with a high productivity, and a good plating appearance and plating adhesion can also be achieved.

These and other objects, features and advantages of the present invention will become apparent upon reading the following detailed description of embodiments of the invention, when taken in conjunction with the appended claims.

DETAILED DESCRIPTION OF EXEMPLARY EMBODIMENTS OF THE INVENTION

Exemplary embodiments of the present invention may be used to process steel sheet containing between 0.02% and 0.2% C, and between 0.15% and 2.5% Mn. In addition, between 0.2% and 3% Si may also be present.

A state of the base sheet used can be important for processing in accordance with exemplary embodiments of the present invention. For example, a pickled hot rolled steel sheet or an annealed and pickled cold rolled steel sheet can be used. Various conventional pickling techniques may be used for the hot rolled steel sheet to remove any surface scale which may be present. Applying a cooling procedure using water (such as, e.g., vaporization cooling) to a steel sheet may likely form with a scale on the surface, so a conventional technique for pickling such cold rolled steel sheet at a back surface in the annealing line can be performed. Such sheet can be used as a base sheet in exemplary embodiments of the present invention. However, sheet passing through gas cooling, etc., during a cooling step may likely not be pickled at a back surface in the annealing line, and such steel sheet should be pickled for use in accordance with exemplary embodiments of the present invention.

When the pickled hot rolled steel sheet or annealed, pickled cold rolled steel sheet described above are preplated with Ni, pickling can be performed as a pretreatment. For example, pickling twice when combined with the pickling of the base sheet can be performed in accordance with exemplary embodiments of the present invention. Thus, a significant degree of alloying can be achieved under conditions which may avoid deterioration of strength and/or ductility of the sheet.

A number of pickling treatments can be determined in accordance with exemplary embodiments of the present invention. For example, a steel sheet may pass through a plurality of pickling tanks. However, if the steel sheet is not dried between one tank and another tank, even if a plurality of tanks are used, the pickling procedure can be considered to be a single treatment. By drying the sheet (e.g., rinsing and then drying) after crystal grains are corroded due to the pickling, oxygen in the atmosphere may cause a surface of the sheet to be thinly oxidized. Repeated pickling of the surface of the steel sheet in such oxidized state can allow C and Mn to be removed uniformly and effectively, and, as a result, a high alloying speed and uniform plating appearance can be achieved. Thus, drying of the steel sheet between one pickling treatment and another pickling treatment can be important.

Pickling may be performed using, e.g., an aqueous solution of sulfuric acid or hydrochloric acid. Other acids may inhibit alloying, and thus may not be preferred. The sheet may be degreased to remove any dirt before a main pickling treatment, and mechanical grinding, e.g., using brushes, etc., may also be performed.

Conditions used for rinsing which may be performed after a pickling treatment can also be important. For example, rinsing followed by drying may preferably be avoided before the Ni preplating procedure. Further, a pH of the rinsing water may preferably be less than 6. Ni may also be preplated onto the sheet as-is after pickling, e.g., without subsequent rinsing or drying. If the above conditions are not met, alloying may be inhibited.

In exemplary embodiments of the present invention, the amount of Ni preplating can be between 0.2 $g/m^2$ and 2 $g/m^2$. If the amount of Ni is less than the lower limit, the wettability of the plating may become insufficient or a sufficient degree of alloying may not be obtained. Preplating Ni in an amount greater than the upper limit may not provide further beneficial effects (e.g., the effect of Ni becomes saturated), and the use of such excess Ni can be uneconomical. A variety of Ni preplating conditions may be used such as, e.g., a sulfuric acid bath, a chlorination bath, a watt bath, a sulfamic acid bath, or other conventional baths.

After preplating with Ni, the sheet can be rapidly heated in a nonoxidizing or reducing atmosphere to a sheet temperature of 430° to 500° C. at a heating rate of 30° C./sec or more. This heat treatment can secure wettability of the hot-dip plating and improve plating adhesion. After this heating procedure, the sheet can be hot-dip galvanized and wiped to adjust the basis weight. The concentration of Al in the hot-dip galvanizing bath can be between 0.05% and 0.2%. If less than 0.05% Al is present in the bath, the plating adhesion may easily deteriorate, while if over 0.2% Al is present, achieving both sufficient alloying and quality can become difficult.

After the sheet is wiped, it can be heated to a temperature of 470° C. to 550° C. at a heating rate of 30° C./sec or more. The sheet can then be cooled without any soaking time, or it can be held for soaking for less than 10 seconds and then cooled, to alloy the sheet. This procedure can be important for preventing or minimizing a deterioration of strength and ductility, and for achieving a sufficient degree of alloying.

Hot-dip galvannealing of P-containing steel sheet can also be achieved in accordance with certain exemplary embodiments of the present invention. For example, a P-containing steel sheet such as, e.g., a hot rolled sheet, a cold rolled sheet, a low carbon steel sheet, an ultralow carbon steel sheet, etc may be used. Further, steel sheet containing so-called "trump elements" such as Cr, Cu, Ni, and Sn may also be used. Exemplary embodiments of the present invention can achieve both a high alloying speed and a good plating appearance, so they may be particularly effective for processing cold rolled ultralow carbon steel sheet for which a good plating appearance may be desirable. If 0.02% or more of P is present, alloying may be significantly retarded and there may be a significant drop in productivity of the process. Thus, exemplary embodiments of the present invention may be particularly effective for steel sheet containing 0.02% or more of P.

Certain exemplary embodiments of the present invention can include several pickling procedures of a P-containing steel sheet after annealing. For example, certain actions and effects of a first pickling treatment after annealing are described, e.g., in Japanese Patent Publication (B2) No.

7-9055. Annealing to form crystal grains, then reducing the P present in concentrated amounts at crystal grains by pickling can contribute to an improvement of alloying speed. However, when using such a procedure to remove P the crystal grains can be deeply corroded, which may result in a rough surface. Thus, a subsequent plating appearance can become irregular. Further, removal of P which may be present at surfaces inside the crystal grains may not be sufficient, so the improvement in alloying speed can be small.

A variety of pickling procedures may be used in accordance with exemplary embodiments of the present invention. For example, pickling may be performed using conditions such as those described, e.g., in Japanese Patent Publication (B2) No. 7-9055. Such conditions can include treatment of a sheet with a 1% to 5% hydrochloric acid aqueous solution at a temperature of 60° C. to 90° C. for 1 to 10 seconds. A second pickling treatment (or, when pickling more than two times, a final pickling treatment) may also be significant for smoothing rough surface conditions which may be formed by the first pickling (or, when pickling more than two times, the immediately prior pickling treatment). Thus, a sulfuric acid treatment may be preferable to a hydrochloric acid treatment for later or final pickling treatments. For example, a treatment in a 5% to 15% sulfuric acid aqueous solution at a temperature between room temperature and 70° C. for 1 to 10 seconds may be used.

After the pickling treatment described herein, and before hot-dip galvanizing, the steel sheet can be preplated with Ni and heated to a temperature of 430° C. to 500° C. After this preplating, which can provide surface activation, the sheet can be plated in a hot-dip galvanizing bath containing between 0.05% and 0.2% Al. If less than 0.05% Al is present, a high alloying speed can be obtained but the plating adhesion may deteriorate. If more than 0.2% Al is present, a sufficient alloying speed may not be achieved.

Alloying conditions which may be, used after plating can include, e.g., heating the sheet to a temperature of 470° C. to 600° C. at a heating rate of 2° C./sec or more, then cooling the sheet with no soaking time, or holding the sheet for soaking for less than 5 seconds and then cooling. Such treatment can provide a good plating appearance and good plating adhesion, and productivity may not be impaired.

Example 1

Exemplary procedures for producing high strength, high ductility hot-dip galvannealed steel sheet can be performed in accordance with exemplary embodiments of the present invention. For example, Table 1 lists characteristics of base sheets used for such exemplary procedures. Base sheet 1 and base sheet 2 are cold rolled, annealed, pickled steel sheets. Base sheet 3 is a pickled hot rolled steel sheet. Qualities of materials measured after temper rolling the base sheets are provided in Table 3.

The base sheets were degreased using the exemplary conditions provided in Table 2. Pickling of certain sheets was performed using exemplary conditions listed in Table 3. Ni preplating was performed by electroplating using exemplary conditions listed in Table 4.

After Ni preplating, the sheets were heated in a 3% $H_2$+$N_2$ atmosphere at a heating rate of 30° C./sec up to a temperature of 450° C. They were then immediately dipped in a hot-dip galvanizing bath (containing 0.15% Al), held at 450° C. for 3 seconds, and wiped to adjust the basis weight to 50 g/m$^2$. The sheets were then alloyed right above the wiping using predetermined heating rates, temperatures, and soaking times. The sheets were cooled gradually at a rate of 2° C./sec for 8 seconds, then rapidly cooled at a rate of 20° C./sec. After cooling, the sheets were temper rolled at reduction rates of 0.5%.

Exemplary process conditions and evaluation observations for the sample sheets are shown in Table 5. An alloying degree was determined by dissolving a plating layer of a sample in hydrochloric acid, chemical analysis was used to determine composition, and the percentage of Fe in the plating layer was calculated. Samples exhibiting 9% or more of Fe were labeled "Good," while those exhibiting less than 9% of Fe were labeled "Poor." Material quality was assessed by measuring a value for TS×El (Mpa·%) of each sample, where TS represents a tensile strength, and EL represents an elongation value to failure. Samples which exhibited less than a 10% drop in the value of TS×El as compared with the original value for the base sheet (shown in Table 1) were labeled as "Good," and samples which showed a decrease greater than 10% were labeled as "Poor."

TABLE 1

Test Base Sheet

| | | Ingredients (mass %) | | | | | Material characteristics after temper rolling | | |
|---|---|---|---|---|---|---|---|---|---|
| | Type | C | Mn | Si | P | S | YP (Mpa) | TS (Mpa) | EL (%) |
| Base sheet 1 | Cold rolled | 0.07 | 1.87 | 0.45 | 0.015 | 0.006 | 368 | 621 | 32 |
| Base sheet 2 | Cold rolled | 0.09 | 1.73 | 1.3 | 0.009 | 0.002 | 446 | 821 | 23 |
| Base sheet 3 | Hot rolled | 0.2 | 1.59 | 1.58 | 0.009 | 0.001 | 567 | 806 | 27 |

TABLE 2

Alkali Degreasing Conditions

| | |
|---|---|
| NaOH | 50 g/liter |
| Solution temperature | 65° C. |
| Dipping | 10 sec |

TABLE 3

Pickling Conditions

| | |
|---|---|
| $H_2SO_4$ | 100 g/liter |
| Solution temperature | 60° C. |
| Dipping | 10 sec |

TABLE 4

| Ni Preplating Conditions | |
|---|---|
| Ingredients | Concentration |
| $NiSO_4 \cdot 6H_2O$ | 300 g/liter |
| $H_3BO_3$ | 40 g/liter |
| $Na_2SO_4$ | 100 g/liter |
| pH | 2.7 |

After this procedure, the sheets were heated in a 3% hydrogen+95% nitrogen atmosphere at a rate of 40° C./sec to a temperature of 460° C., and then immediately dipped in a hot-dip galvanizing bath held at 455° C. which contained Al. The exemplary sheets were then wiped to adjust the plating to a basis weight of 60 g/m$^2$. The concentrations of Al provided in the hot-dip galvanizing baths are as shown in Table 7. After wiping, the sheets were heated at a rate of 50° C./sec to the predetermined temperatures shown in Table 7, soaked for predetermined times, gradually cooled at a rate of 10° C./sec for 3 seconds, and then cooled at a rate of 20° C./sec to room temperature.

TABLE 5

| Sample Production Conditions and Evaluation Results | | | | | | | | | | |
|---|---|---|---|---|---|---|---|---|---|---|
| | | | | | Alloying | | | | | |
| | | | Drying | Ni | Rate of | | | Evaluation results | | |
| Base sheet | Pickling treat. | Rinsing | before Ni preplating | preplating (g/m$^2$) | temperature rise (° C./s) | Temperature (° C.) | Soaking time (sec) | Alloying degree | Quality | Remarks |
| 1 | Table 1 | Yes | No | 0.2 | 50 | 490 | 0 | Good | Good | Ex. 1 |
| 1 | Table 1 | Yes | No | 0.3 | 50 | 490 | 0 | Good | Good | Ex. 2 |
| 1 | Table 1 | Yes | No | 1 | 50 | 490 | 0 | Good | Good | Ex. 3 |
| 1 | Table 1 | No | No | 0.3 | 50 | 490 | 0 | Good | Good | Ex. 4 |
| 1 | Table 1 | Yes | No | 0.3 | 50 | 470 | 8 | Good | Good | Ex. 5 |
| 1 | Table 1 | Yes | No | 0.3 | 50 | 550 | 0 | Good | Good | Ex. 6 |
| 2 | Table 1 | Yes | No | 0.3 | 50 | 520 | 0 | Good | Good | Ex. 7 |
| 3 | Table 1 | Yes | No | 0.5 | 50 | 530 | 0 | Good | Good | Ex. 8 |
| 1 | No | No | Yes | 0.3 | 50 | 490 | 0 | Poor | Good | Comp. Ex. 1a |
| 1 | Table 1 | Yes | Yes | 0.3 | 50 | 490 | 0 | Poor | Good | Comp. Ex. 2a |
| 1 | No | No | Yes | 0.3 | 30 | 500 | 20 | Good | Poor | Comp. Ex. 3a |

As indicated by the results listed in Table 5, exemplary sheets processed in accordance with exemplary embodiments of the present invention exhibited an excellent degree of alloying and a high material quality.

Example 2

Certain exemplary embodiments of the present invention can also be used for hot-dip galvannealing method of a P-containing steel sheet. In the following examples, cold rolled, annealed steel sheets having the compositions shown in Table 6 were used.

TABLE 6

| Ingredients of Test Base Sheets | | | | | | | |
|---|---|---|---|---|---|---|---|
| | Ingredients wt % | | | | | | |
| | C | Mn | Si | P | S | Ti | Nb |
| Base sheet 1 | 0.002 | 0.381 | 0.003 | 0.059 | 0.006 | 0.001 | 0.003 |
| Base sheet 2 | 0.002 | 0.68 | 0.024 | 0.023 | 0.013 | 0.005 | 0.007 |
| Base sheet 3 | 0.004 | 0.39 | 0.12 | 0.095 | 0.011 | 0.013 | 0.016 |

(Examples 9 to 11 and Comparative Example 4a)

Table 7 shows the exemplary combinations of base sheets and treatment conditions used. After a first pickling, the exemplary sheets were rinsed and dried. Except for Comparative Example 4a, the sheets were pickled a second time, rinsed, and then preplated with Ni to a deposition amount of 0.3 g/m$^2$ using the electroplating conditions shown in Table 4. The exemplary pickling conditions used are shown in Table 8.

Evaluation of the exemplary procedures described herein was conducted as follows:

Plating appearance: Sheets which exhibited no visual unevenness and appeared to be uniform in appearance were labeled as "Good," while those exhibiting unevenness or patterns in appearance and which may not be suitable for use (e.g., for automobile external panel applications) were labeled as "Poor."

Alloying degree: The plating layer of a sample sheet was dissolved in hydrochloric acid, and chemical analysis was used to determine its composition and thereby calculate the percentage of Fe present in the plating layer. Samples exhibiting 9% or more of Fe in the plating layer were labeled as "Good," and those exhibiting less than 9% of Fe in the plating layer were labeled as "Poor."

Plating adhesion: Sheets were bent into a 60° V shape, and plating peeling at the bent portion was then evaluated using a tape peeling technique. Samples exhibiting a peeling distance of less than 2 mm were labeled as "Good," and samples exhibiting a greater peeling distance were labeled as "Poor."

TABLE 7

Sample Preparation Conditions and Results of Evaluation

| Base sheet | Pickling treatment 1st | Pickling treatment 2nd | Hot-dip galvanization Al concentration % | Alloying treatment Temp. | Alloying treatment Soaking time | Plating appearance | Alloying degree | Plating adhesion | Remarks |
|---|---|---|---|---|---|---|---|---|---|
| Base sheet 1 | Pickling a | Pickling c | 0.15 | 520 | 0 | Good | Good | Good | Ex. 9 |
| Base sheet 2 | Pickling a | Pickling c | 0.15 | 520 | 0 | Good | Good | Good | Ex. 10 |
| Base sheet 3 | Pickling a | Pickling c | 0.15 | 520 | 0 | Good | Good | Good | Ex. 11 |
| Base sheet 1 | Pickling b | — | 0.15 | 530 | 15 | Poor | Good | Good | Comp. Ex. 4a |

TABLE 8

Pickling Treatment Conditions

| | Solution | Concentration | Temperature | Time |
|---|---|---|---|---|
| Pickling a | Hydrochloric acid | 5% | 80° C. | 2 sec |
| Pickling b | Hydrochloric acid | 5% | 80° C. | 2 sec × 2 times* |
| Pickling c | Sulfuric acid | 10% | 30° C. | 5 sec |

*Pickling b included two seconds of treatment in each of two pickling tanks. No rinsing or drying was performed between the pickling tanks.

As indicated by the results listed in Table 7, exemplary sheets processed in accordance with exemplary embodiments of the present invention (e.g., Examples 9-11) exhibited an excellent degree of alloying, plating appearance, and plating adhesion. These exemplary results were obtained with a short alloying treatment, as described herein.

INDUSTRIAL APPLICABILITY

Exemplary embodiments of the present invention can produce hot-dip galvannealed steel sheet exhibiting excellent quality and degree of alloying degree. Certain exemplary embodiments of the present invention can further be used to hot-dip galvanneal P-containing steel sheet with a high productivity and achieve both good plating appearance and good plating adhesion. The industrial value of such processing methods is significant.

The invention claimed is:

1. A method for producing a high-strength hot-dip galvannealed steel sheet, the method comprising, sequentially:

pickling a high-strength steel sheet in an aqueous solution of hydrochloric acid, the high-strength steel sheet including a pickled base steel sheet;

drying the pickled high-strength steel sheet;

optionally rinsing the dried steel sheet;

further pickling the dried high-strength steel sheet in an aqueous solution of sulfuric acid;

preplating the high-strength steel sheet with between 0.2 $g/m^2$ and 2.0 $g/m^2$ of Ni;

heating the high-strength steel sheet in a nonoxidizing atmosphere to a temperature between about 430° C. and about 500° C. with a heating rate of more than 30° C./sec, in a non-oxidizing or reducing atmosphere;

hot-dip plating the high-strength steel sheet in a hot-dip galvanizing bath containing between 0.05% and 0.2% of Al;

alloying the high-strength steel sheet by rapidly heating the plated steel sheet to a temperature of about 470 to about 550° C. with a heating rate of more than 20° C./sec;

cooling the alloyed steel sheet by one of: (i) cooling without soaking; or (ii) holding the steel sheet for soaking for less than about 15 seconds; and further cooling the steel sheet to produce the high-strength hot-dip galvannealed steel sheet.

2. The method of claim 1, wherein the high-strength steel sheet comprises between 0.2% and 3% of Si.

3. The method of claim 1, wherein the high-strength steel sheet is an annealed sheet comprising at least 0.02% of P.

4. The method of claim 1, wherein the high strength steel sheet is a hot-rolled steel sheet, a cold-rolled steel sheet, or an annealed steel sheet including: C: 0.02 to 0.2%, Si: 0.2 to 3%, Mn: 0.15 to 2.5%, P: at least 0.02% , and a balance of Fe and unavoidable impurities.

* * * * *